US005928063A

United States Patent [19]

James et al.

[11] Patent Number: 5,928,063

[45] Date of Patent: *Jul. 27, 1999

[54] PNEUMATICALLY ASSISTED UNIDIRECTIONAL ARCUATE DIAPHRAGM CONFORMAL TOOL

[75] Inventors: Michael D. James, Gibson; Fritz R. Kruis, Tulsa, both of Okla.

[73] Assignee: Coburn Optical Industries, Inc., Tulsa, Okla.

[ * ] Notice: This patent is subject to a terminal disclaimer.

[21] Appl. No.: 08/876,035

[22] Filed: Jun. 13, 1997

Related U.S. Application Data

[63] Continuation-in-part of application No. 08/642,351, May 3, 1996, Pat. No. 5,662,518.

[51] Int. Cl.[6] ..... B24B 1/00

[52] U.S. Cl. ..... 451/41; 451/313

[58] Field of Search ..... 451/41, 42, 43, 451/44, 55, 384, 390, 59, 57, 913, 921, 504, 505, 313

[56] References Cited

U.S. PATENT DOCUMENTS

| | | | |
|---|---|---|---|
| 4,802,309 | 2/1989 | Heynacher | 451/41 |
| 5,520,568 | 5/1996 | Craighead et al. | 451/390 |
| 5,577,950 | 11/1996 | Smith et al. | 451/384 |
| 5,662,518 | 9/1997 | James et al. | 451/384 |

*Primary Examiner*—David A. Scherbel
*Assistant Examiner*—Derris H. Banks
*Attorney, Agent, or Firm*—Frank J. Catalano

[57] ABSTRACT

A tool for polishing/fining an ophthalmic lens has a housing with an interior open at the ends thereof. Resiliently elastic diaphragms with central spherical work surfaces extend across the ends of the housing. A cluster of rods extends longitudinally in sliding abutment within the housing from one diaphragm work surface to the other. A cap has a rim which fixes the exterior perimeter of the first diaphragm against the top of the housing. The cap defines a pneumatic chamber longitudinally aligned between the exterior surface of the first diaphragm and the interior wall of the cap. A passage through the cap wall admits air under pressure into the chamber. A ring fixes the exterior perimeter of the other diaphragm against the bottom of the housing. Preferably the cap and ring thread onto the housing with the diaphragms therebetween. Pneumatic distortion of one diaphragm is transmitted by longitudinal displacement of individual ones of the cluster of rods to the interior surface of the other diaphragm. This causes the other diaphragm to dynamically comply to the surface of a lens as the other diaphragm and the lens are relatively laterally displaced. Most preferably, the interior opening of the housing will be polygonal and extend through a spherical indention on one end of the housing and a spherical protrusion on the other end of the housing to provide maximum longitudinal control of rod displacement. An hexagonal opening and rod cluster has been found to work very satisfactorily.

26 Claims, 7 Drawing Sheets

PNEUMATICALLY ASSISTED UNIDIRECTIONAL ARCUATE DIAPHRAGM CONFORMAL TOOL

CROSS REFERENCE TO RELATED APPLICATION

This application is a continuation-in-part of copending application Ser. No. 08/642,351 filed on May 3, 1996, for "PNEUMATICALLY ASSISTED UNIDIRECTIOAL CONFORMAL TOOL."

BACKGROUND OF THE INVENTION

This invention relates generally to the manufacture of ophthalmic lenses and more particularly concerns conformal tools for fining and polishing ophthalmic lenses.

Most known finishing/polishing tools provide a global conformance to the lens, requiring a separate tool for every possible contour of lens. For each lens, the proper tool has to be selected and mounted on the fining/polishing apparatus. With recent development of more accurate lens surfacing equipment, modern lenses exhibit wide variations in face curvature.

While some work has been done in the development of conformal tools which can be used to fine/polish a variety of lenses, little success has been achieved in developing a single or minimal number of fining/polishing tools which will conform to all contours of lenses including toric lenses. For the most part, improved conformal tools are progressively incremented in diopter ranges so that the tool does not accurately conform progressively at any position of a lens contour. Thus, the fining/polishing process can adversely effect the accuracy of the lens geometry.

One presently known conformal tool applies air pressure under the control of the operator in the bladder of the conformal tool to control the degree of conformance to the lens. However, the use of air pressure or hydraulic pressure in the tool bladder under operator control introduces considerable inaccuracy into the system. In addition, the face of the tool tends to buckle and lose its integrity with the lens surface, introducing further error into the system.

Other recently developed conformal tools use a conformable filler in a pliant casing to contour the tool to the lens. Such tools eliminate the introduction of error due to the operator's subjective introduction of air into the bladder. However, all the fluids or particles of the conformable filler are free to shift in any direction in response to the many forces exerted on the tool including the rotational motion of the tool and the axial displacement of the tool as well as the contour of the lens. Consequently, not all fluid or particle movement is directed toward achieving conformance.

It is, therefore, an object of this invention to provide a conformal tool for fining/polishing ophthalmic lenses affording unidirectional movement of the conformal medium toward the lens. Another object of this invention is to provide a conformal tool for fining/polishing ophthalmic lenses which restricts movement of the conformal medium in any direction other than toward the lens. Still another object of this invention is to provide a conformal tool for fining/polishing ophthalmic lenses which transforms multidirectional pneumatic pressure into unidirectional mechanical force to achieve conformance of a diaphragm to a lens. It is also an object of this invention to provide a conformal tool for fining/polishing ophthalmic lenses which uses a diaphragm to transfer multidirectional pneumatic pressure to a cluster of rods unidirectionally arranged in slidable tangential contact with each other. A further object of this invention is to provide a conformal tool for fining/polishing ophthalmic lenses which is capable of fining and polishing any lens within the range of piano to 14 diopters. Another object of this invention is to provide a conformal tool for fining/polishing ophthalmic lenses which is capable of fining and polishing any lens within a range of piano to 14 diopters with at least the added capability of 4 diopters of cylinder. Yet another object of this invention is to provide a conformal tool for fining/polishing ophthalmic lenses which is usable for both fining and polishing.

SUMMARY OF THE INVENTION

In accordance with the invention, a tool is provided which has an outer shell or housing containing a bundle of rods of a plastic material, all of the rods being of equal length. The clustered rods are individually free to move up and down unidirectionally along their vertical axes but are constrained against relative motion in any other direction. Preferably, the rods are encased in an open ended tubular housing, the open ends being closed by two resiliently elastic diaphragms, one located at each end of the housing. An air chamber at one end of the housing receives compressed air and exerts pressure upon a first of the diaphragms. The first diaphragm in turn exerts pressure upon the abutting ends of the rods, forcing the opposite ends of the rods against the second diaphragm which in turn stretches to move with the rods. The second diaphragm, or a conformal pad applied to it, contacts the surface of the lens during fining and polishing. The second diaphragm is stretched by the unidirectionally driven rods to provide a sponge-like pad which conforms to the surface of the lens. As the diaphragm is moved over the surface of the lens, it complies vertically with the change in the lens surface contour immediately and appears to "flow" over the lens surface. However, the clustered rods simultaneously resist changes that are made in a horizontal mode, thus presenting a hard surface to the lens and allowing the abrasives on the conformal pads applied to the second diaphragm to have a positive effect while being moved.

The tubular housing is typically, but not necessarily, interiorly cylindrical. In one embodiment, the rods are held in an hexagonal bundle by six identical isometric trapezoidal plates girded by a pair of O-rings seated in slots at the plate junctions. The O-rings are slightly compressed between the housing inner wall and the plates to secure the hexagonal assembly within the cylindrical housing.

Preferably, the second resiliently elastic diaphragm has a central spherical work surface approximating a contour of the lens to be polished/fined and the rods extend longitudinally from the first diaphragm to the second diaphragm spherical work surface. It is preferred that the first diaphragm also has a central spherical work surface approximating the contour of the lens to be polished/fined and that the rods, therefore, be of equal length.

Most preferably, a right cylindrical housing is used which has a spherical protrusion surrounded by a planar surface on one end and a spherical indentation surrounded by a planar surface in the other end. A right polygonal interior extends through the protrusion and the indentation. The first and second resiliently elastic diaphragms are fixed across the planar surfaces. A polygonal cluster of rods of equal length is longitudinally aligned in sliding abutment within the right polygonal housing interior. Hexagonal housing interiors and rod clusters have been found to work very satisfactorily.

In the most preferred embodiment, each diaphragm has a peripheral web extending from its central work surface to its perimeter which is contoured to juxtaposition the diaphragm perimeter against the housing planar surfaces. The cap has a rim with an annular seat disposed against the first diaphragm perimeter and the ring is disposed against the second diaphragm perimeter. Each diaphragm has an integral bead along its perimeter. The cap has a first annular groove in the seat into which the first diaphragm bead is nested and the housing has a second annular groove in one of its planar surfaces into which the second diaphragm bead is nested. One washer may be disposed between the first diaphragm bead and the planar surface of the housing and another washer disposed between the second diaphragm bead and the ring. Preferably, the cap is threadedly engaged on the housing to seal the first diaphragm bead in the cap annular groove and the ring is threadedly engaged on the housing to seal the second diaphragm bead in the housing annular groove.

BRIEF DESCRIPTION OF THE DRAWINGS

Other objects and advantages of the invention will become apparent upon reading the following detailed description and upon reference to the drawings in which.

Figure 1:
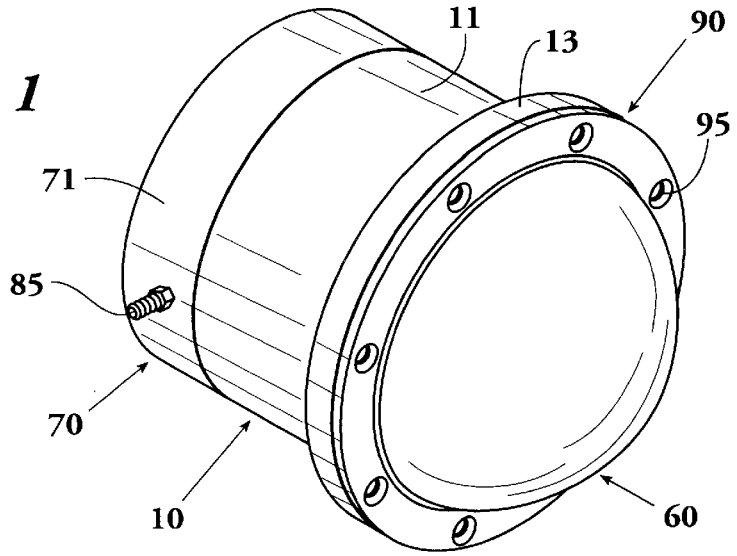
FIG. 1 is a perspective view of one embodiment of the pneumatically assisted unidirectional conformal tool in a condition in which sufficient pneumatic pressure has been applied to the first diaphragm to unidirectionally shift the rods and stretch the second diaphragm toward conformal contact with the lens.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Looking at FIGS. 1–5, the components of one embodiment of the pneumatically assisted unidirectional conformal tool include a housing 10, containing a cluster of rods 30 between a top diaphragm 50 and a bottom diaphragm 60. The top diaphragm 50 is sandwiched against the housing 10 by a pneumatic cap 70 and the bottom diaphragm 60 is sandwiched against the housing 10 by a bottom ring 90.

As shown, the housing 10 consists of a cylindrical wall 11 having an annular flange 13 about its lower end in a tophat-like configuration. An annular bevel 15 is provided along the inner periphery of the upper portion of the cylindrical wall 11. A plurality of tap holes 17 are provided into the top face of the cylindrical wall 11 outside of the bevel 15, the tap holes 17 extending longitudinally into the cylindrical wall 11 at intervals about its circumference. As shown, eight tap holes 17 are equally spaced in the top of the cylindrical wall 11. Another set of tap holes 19 are provided in the annular flange 13, the lower tap holes 19 extending longitudinally into the flange 13 at intervals circumferentially spaced about the flange 13. As shown, eight lower tap holes 19 are equally spaced apart in the flange 13. The outer beveled diameter 21 of the cylindrical wall 11 is greater than its inner wall diameter 23 and less than the diameter 25 along which the lower tap holes 17 are arranged. Alternatively, the thickness of the cylindrical wall 11 could be increased to be substantially equal to the outer diameter of the flange 13 so that the tap holes 13 and 17 can be longitudinally aligned and drilled as a common hole throughout the length of the cylindrical wall 11. Preferably, the housing 10 will be made of plastic material, perhaps by injection molding.

The housing 10 contains a cluster of rods 30 with the length 31 of each of the rods of the cluster 30 being equal to the length of the housing 10. Typically, the length 31 will be in the range of 3" and the diameter 33 of each of the rods in the cluster 30 will be approximately 0.125". However, the diameter of the rods of the cluster 30 may be varied considerably. Smaller diameter rods will provide greater contour accuracy while larger diameter rods will provide a longer lasting tool. Preferably, the bottom ends 37 of the individual rods of the cluster 30 will be rounded to further enhance contour accuracy. A lubricant 39, such as oil, water or other mildly lubricating substance, may be provided in the housing 10 to assure that the rods of the cluster 30 do not bind against each other or against the inner surface of the cylindrical wall 11 as the rods move unidirectionally in the housing 10. The cluster of rods 30 will include a sufficient number of rods to restrict non-longitudinal movement. Preferably, the rods of the cluster 30 will be made of a plastic material, preferably DELRIN.

The cluster of rods 30 is maintained within the housing 10 by a top diaphragm 50 and a bottom diaphragm 60. The top diaphragm 50 has a diameter 51 substantially equal to the outer diameter of the cylindrical wall 11 and is provided with apertures 53 which align with the upper tap holes 17 in the cylindrical wall 11. The bottom diaphragm 60 has a diameter 61 which is substantially equal to the outer diameter of the flange 13 and has a plurality of apertures 63 aligned with the lower tap holes 19 in the flange 13. The diaphragms 50 and 60 are preferably made of a silicon elastomer material which, in an unstressed condition, will lie in a planar relationship across the upper and lower ends of the housing 10.

The upper diaphragm 50 is sandwiched in place against the upper face of the housing 10 by a pneumatic cap 70 which consists essentially of a cylindrical body 71 having an outer diameter substantially equal to the outer diameter of the cylindrical wall 11 of the housing 10. A socket 73 is provided in the upper face of the pneumatic cap 70 for coupling the tool to the chuck of a surface enhancing machine (not shown). An annular air chamber or passage 75 is provided in the lower face of the cap 70 and defines an interior central land 77. A space 99 extends between the land 77 and the upper diaphragm 50 when the cap 70 is seated on the diaphragm 50. Apertures 81 are provided longitudinally in the periphery of the cap 70 which align with the upper tap holes 17 in the housing 10. The diameter 83 of the air chamber or passage 75 is preferably greater than the inner diameter 23 of the housing 10 and less than the outer diameter 21 of the bevel 15 in the housing 10. An air inlet port 85 is provided through the wall of the cap 70 to provide pneumatic access to the annular air chamber or passage 75. Preferably, the caps 70 will be made of plastic, perhaps injection molded.

The lower diaphragm 60 is sandwiched against the bottom face of the housing 10 by a bottom ring 90 of outer diameter substantially equal to the outer diameter of the flange 13 of the housing 10. Preferably, the upper inner periphery of the ring 90 will have an annular bevel 91. The inner diameter 93 of the ring 90 is substantially greater than the inner diameter 23 of the housing 10. A plurality of apertures 95 are circumferentially spaced and longitudinally aligned through the ring 90 in alignment with the lower tap holes 19 in the flange 13 of the housing 10. Preferably, the bottom ring 90 will be of plastic, perhaps injection molded.

In assembling the tool, the lower diaphragm 60 is placed in planar relationship over the lower end of the housing 10 with the lower tap holes 19 of the housing 10 aligned with the apertures 63 in the ring 60. The bottom ring 90 is then laid over the bottom diaphragm 60 with its apertures 81 aligned with the apertures 63 in the bottom diaphragm 60. Screws (not shown) are then tightened through the bottom ring apertures 95 into the housing tap holes 19 to firmly clamp the bottom diaphragm 60 between the housing 10 and the bottom ring 90. A rod cluster 30 of suitable diameter 35 to maintain the rods in longitudinal alignment within the housing 10 is dropped into the housing 10 through its open upper end. A small amount of lubricant 39 is also introduced into the housing 10 to lubricate the contacting surfaces of the rods with each other and with the inner wall of the housing 10. The top diaphragm 50 is then laid in planar relationship over the upper end of the housing 10 with the diaphragm apertures 63 aligned with the upper housing tap holes 17. The cap 70 is then laid over the top diaphragm 50 with its apertures 81 aligned with the housing upper tap holes 17. Screws (not shown) are thus tightened through the cap apertures 81 into the housing upper tap holes 17 to clamp the top diaphragm 50 between the housing 10 and the cap 70. The completed tool can then be mounted for operation on a surface enhancing machine (not shown) by coupling the chuck (not shown) of the machine with the chuck socket 73 in the tool. A pad (not shown) having the desired abrasive quality can then be overlaid on the lower diaphragm 60 for contact with the lens (not shown) to be fined or polished.

In operation, with the tool mounted on the machine, air under pressure is admitted into the chamber 75 in the cap 70 through the air inlet passage 85. Typically, the air pressure in an approximately 3" diameter housing will be in a range of 2 to 10 psi and preferably approximately 5 to 6 psi. The air pressure in the chamber 75 causes the top diaphragm 50 to be depressed against the rod cluster 30. The multi-directional motion of the top diaphragm 50 in response to the pressure in the chamber 75 causes the diaphragm 50 to resiliently distort, imparting a unidirectional downward motion to the rods in the cluster 30. As shown, the bevel 15 in the housing 10 permits the distortion of the top diaphragm 50 to be more evenly distributed across the top of the rods and also prevents damage to the top diaphragm 50 resulting from an otherwise square or sharp corner at the contact point of the top diaphragm 50 with the housing 10. Similarly, as the rods of the cluster 30 are downwardly driven by the upper or top diaphragm 50, the lower or bottom diaphragm 60 is distorted by the unidirectional force applied by the rods in the cluster 30. Conformance of the bottom diaphragm 60 to the bottom ends of the rods in the cluster 30 is facilitated by the greater inner diameter 93 of the bottom ring 90. The bottom ring bevel 91 further facilitates this conformance as well as prevents sharp edges of the ring 90 from damaging the bottom diaphragm 60.

The air pressure applied to the chamber 75 in the cap 70 is selected or regulated to suit the particular application of the tool. The diaphragm material should insure that lubricants and air do not escape their appropriate chambers. If the depth of the space 79 between the cap land 77 and the planar surface of the top diaphragm 50 is sufficient, the tool can be used to fine or polish concave or convex lenses by appropriate selection of the air pressure in the chamber, the top and bottom diaphragms operating in opposite fashion to that described herein to fine or polish a convex lens.

Figure 4:
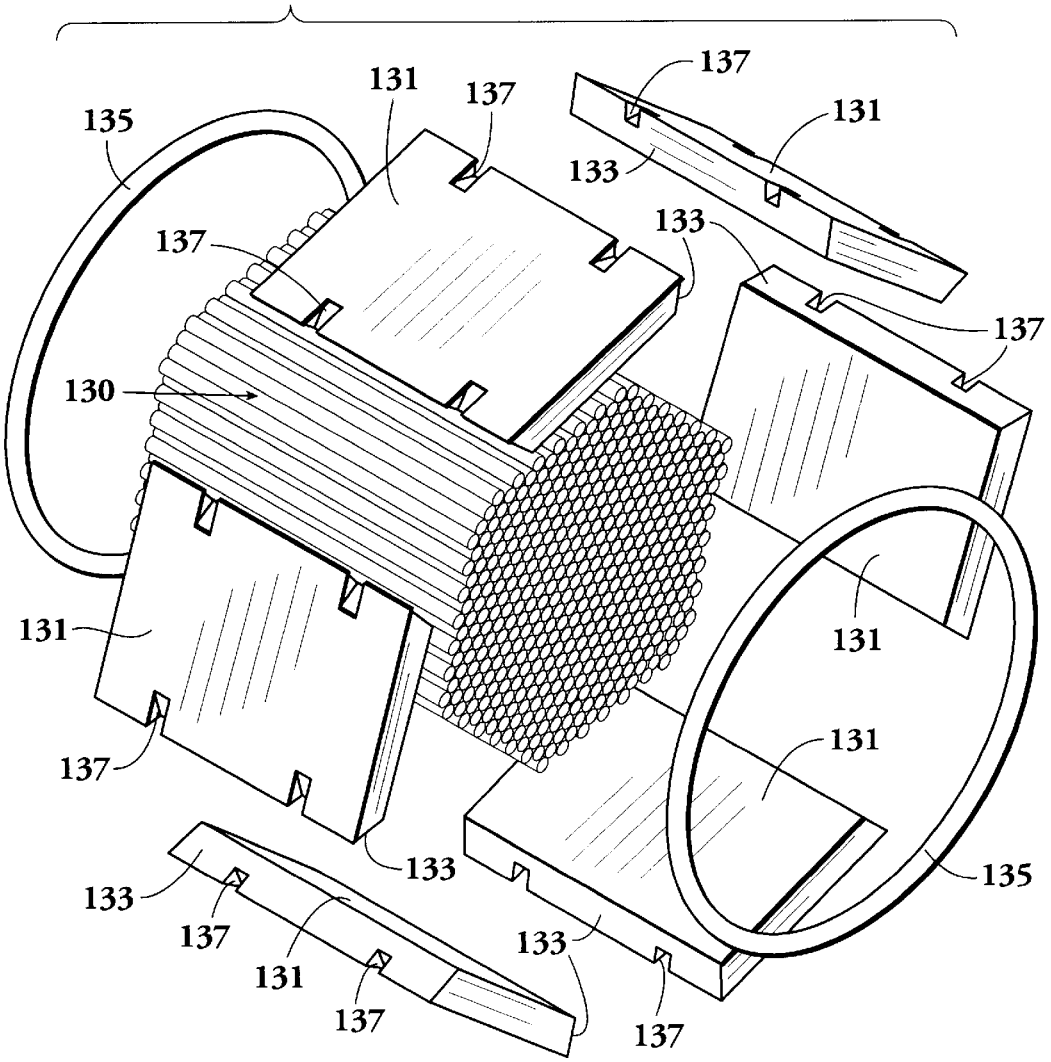
FIG. 4 is a perspective assembly view of the components of a specially preferred embodiment of a rod bundle for use with a pneumatically assisted unidirectional conformal tool such as the tool of FIG. 1.
Figure 5:
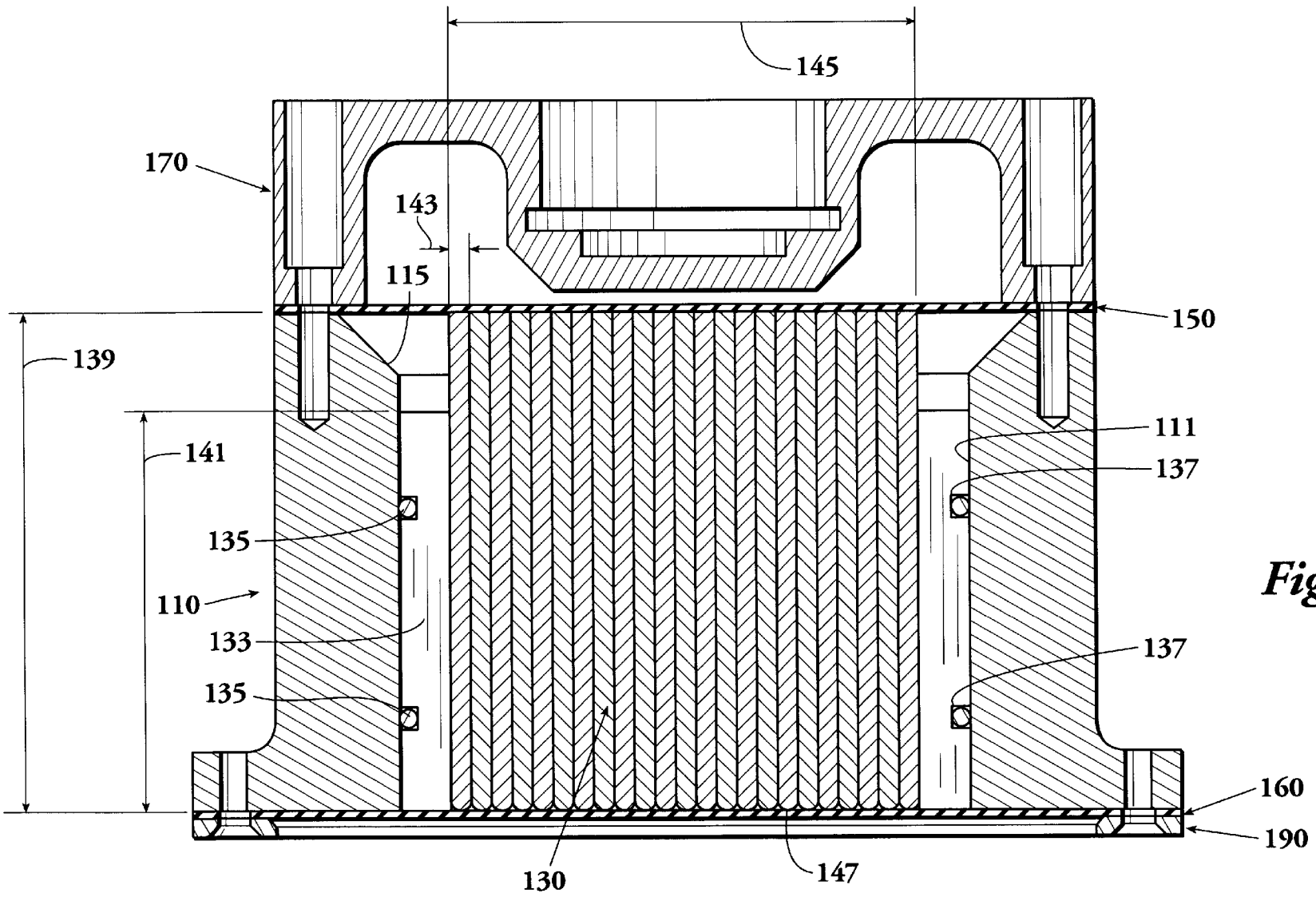
FIG. 5 is a diametric cross-section of the bundle of FIG. 4 loaded into the housing of a conformal tool otherwise identical to the tool of FIG. 1.

In one embodiment of the pneumatically assisted unidirectional conformal tool, an hexagonal rod cluster 130 such as that illustrated in FIG. 4 is loaded into a tool having a housing 110, a top diaphragm 150, a bottom diaphragm 160, a pneumatic cap 170 and a bottom ring 190 which are substantially the same as their corresponding components in the tool described in relation to FIG. 1. The rods are held in the hexagonal cluster 130 by six identical plates 141 of isometric trapezoidal cross-section. The beveled side edges 133 of the plates 131 are held in serial abutment by a pair of O-rings 145 which are stretchable to gird the plates 131 and are seated in slots 137 in the plates 131 which mate at the serial junction points. As can best be seen in FIG. 5, the length 139 of the rods is substantially equal to the length of the housing 110 while the length 141 of the plates 131 is less than the length of the interior wall 111 of the housing 110 from its bottom to its upper annular bevel 115. Preferably, the rods of the cluster 130 will each have a diameter 143 of approximately 0.125 inches, though the diameter of the rods may be varied considerably, and the diameter 145 of the hexagonal cluster 130 will be such as to restrict non-longitudinal movement of the undivided rods. It is also preferred that the bottom ends 147 of the rods will be rounded to further enhance contour accuracy. Also, as can be seen in FIG. 5, the O-rings 135 are compressed between the inner wall 111 of the housing 110 and the trapezoidal plates 131 at the serial junction points of the plates 131 so as to firmly seat the hexagonal plate assembly in the housing 110.

The hexagonal cluster configuration is preferred because it enhances the restriction of non-vertical motion of the rods within the assembly. However, other satisfactory cluster configurations can be achieved by adaptation of a suitable shell interiorly defining the contour of the cluster and exteriorly conformed to the interior of the housing. Preferably, the shell components used are of plastic material, perhaps injection molded. The O-rings are preferably Neoprene. Alternatively, the interior of the housing itself can be contoured to provide the desired cluster cross-section without use of a special shell.

Figure 6:
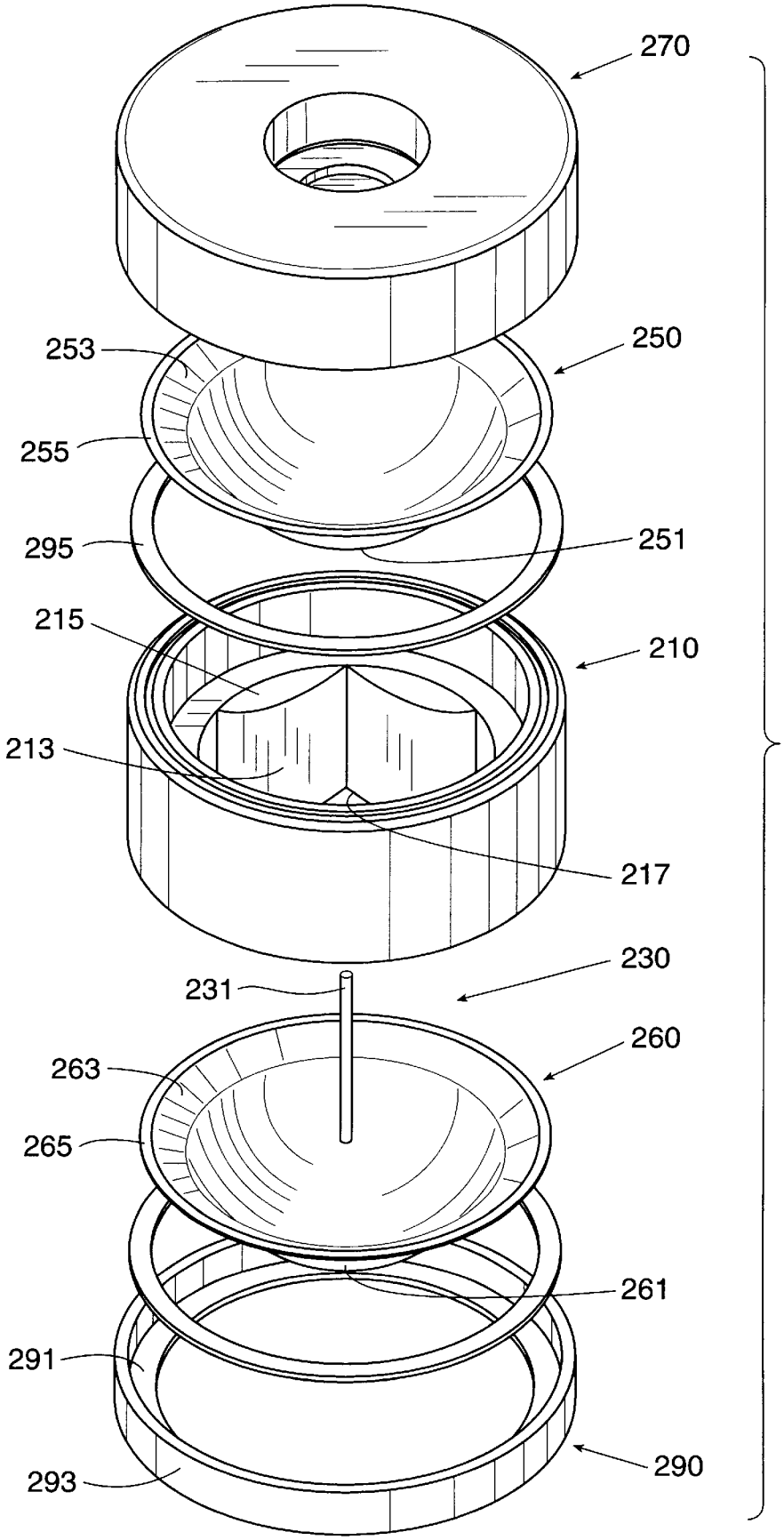
FIG. 6 is a perspective assembly view of the components of a preferred embodiment of the pneumatically assisted unidirectional conformal tool.

A preferred embodiment of the pneumatically assisted unidirectional conformal tool is illustrated in FIG. 6 and includes a housing 210 containing a cluster of rods 230 between a top diaphragm 250 and a bottom diaphragm 260. The top diaphragm 250 will be sandwiched against the housing 210 by a pneumatic cap 270 and the bottom diaphragm 260 will be sandwiched against the housing 210 by a bottom ring 290.

Figure 7:
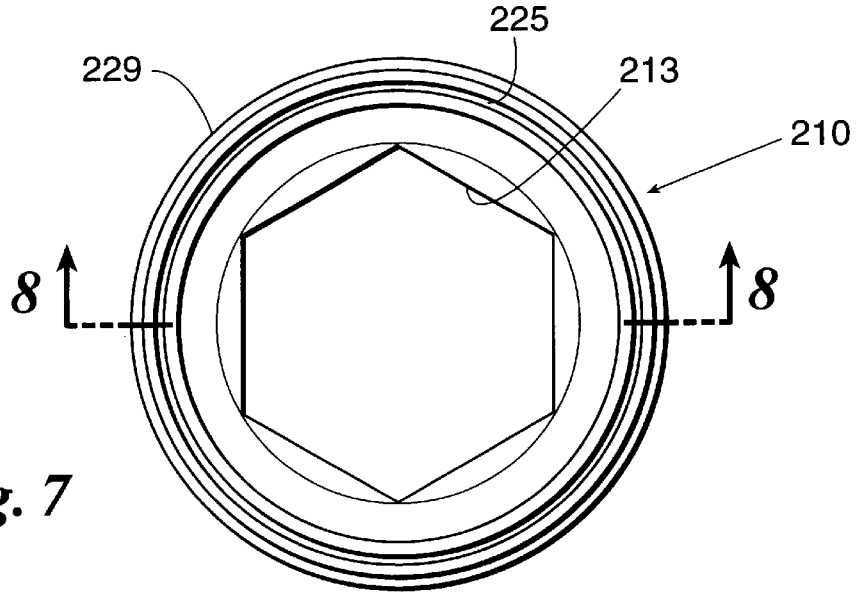
FIG. 7 is a top plan view of the housing of the tool of FIG. 6.
Figure 8:
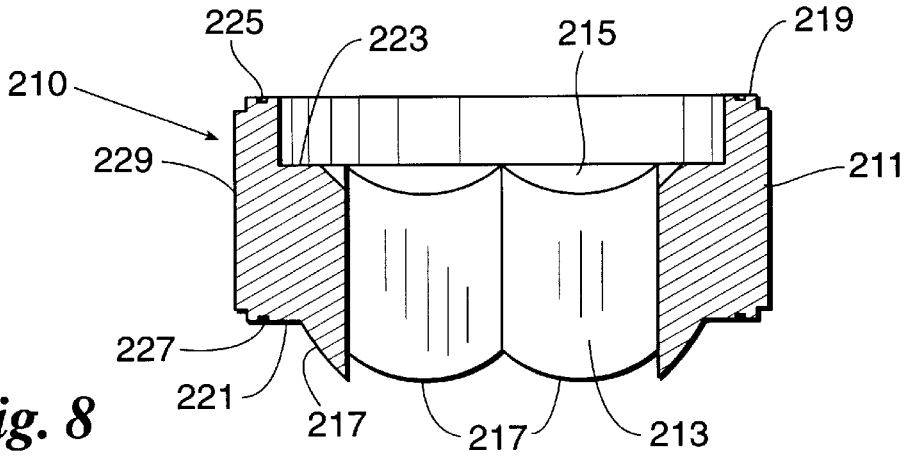
FIG. 8 is a sectional view shown along the line 8—8 of FIG. 7.
Figure 9:
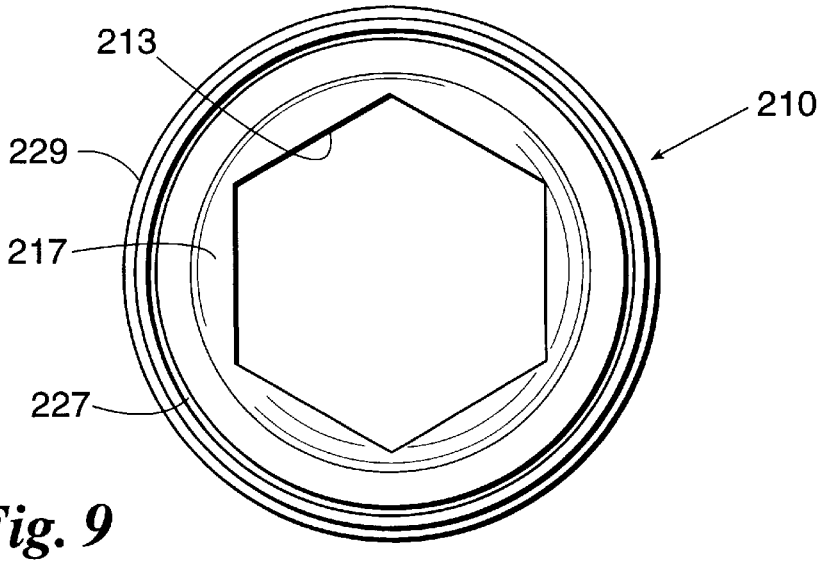
FIG. 9 is a bottom plan view of the housing of the tool of FIG. 6.

A preferred embodiment of the housing 210 is illustrated in FIGS. 7, 8 and 9. The housing 210 consists of a cylinder 211 with a right hexagonal interior 213 open at upper and lower ends thereof. A spherical indentation 215 is provided in the upper end of the cylinder 211 and a spherical protrusion 217 extends downwardly from the bottom of the cylinder 211. The spherical indentation 215 has a first planar surface 219 thereabout and the spherical protrusion 217 has a second planar surface 221 thereabout. A cylindrical seat 223 may also be provided in the first planar surface 219. The first planar surface 219 may be provided with an annular groove 225 and the second planar surface 221 may be provided with a second annular groove 227, each for purposes hereinafter described. Preferably, the outer wall 229 of the cylinder 211 is threaded.

Returning to FIG. 6, the cluster of rods 230, which is represented by a single rod 231, consists of an hexagonal cluster of rods insertable in and longitudinally aligned for sliding abutment within the hexagonal interior 213 of the housing 210. The cluster of rods 230 is maintained within the housing 210 by the upper and lower diaphragms 250 and 260. The upper diaphragm 250 has a central spherical work surface 251 surrounded by a peripheral web 253 which extends from the central spherical work surface 251 to the perimeter of the diaphragm 250. A bead 255 preferably extends along the diaphragm perimeter. The lower diaphragm 260 also has a central spherical work surface 261 surrounded by a peripheral web 263 which extends to its perimeter. A bead 265 preferably extends along the diaphragm perimeter. In this preferred embodiment, the rods 231 of the cluster 230 are of equal length and extend from the upper diaphragm central spherical work surface 251 to the lower diaphragm central spherical work surface 261. The central spherical work surfaces 251 and 261 are both contoured to approximate the contour of the lens to be polished/fined.

Figure 2:
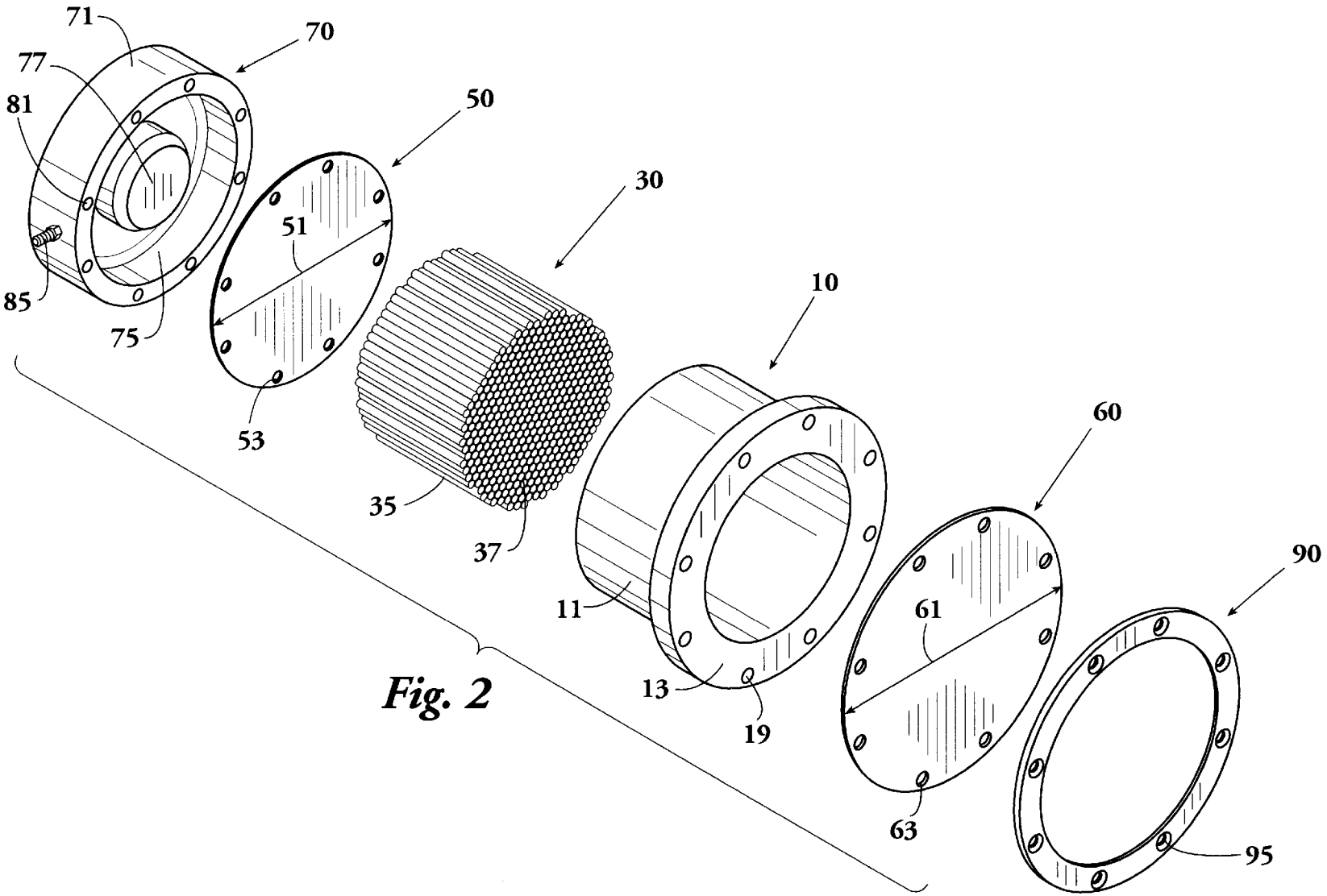
FIG. 2 is a perspective assembly view of the components of the pneumatically assisted unidirectional conformal tool of FIG. 1.
Figure 3:
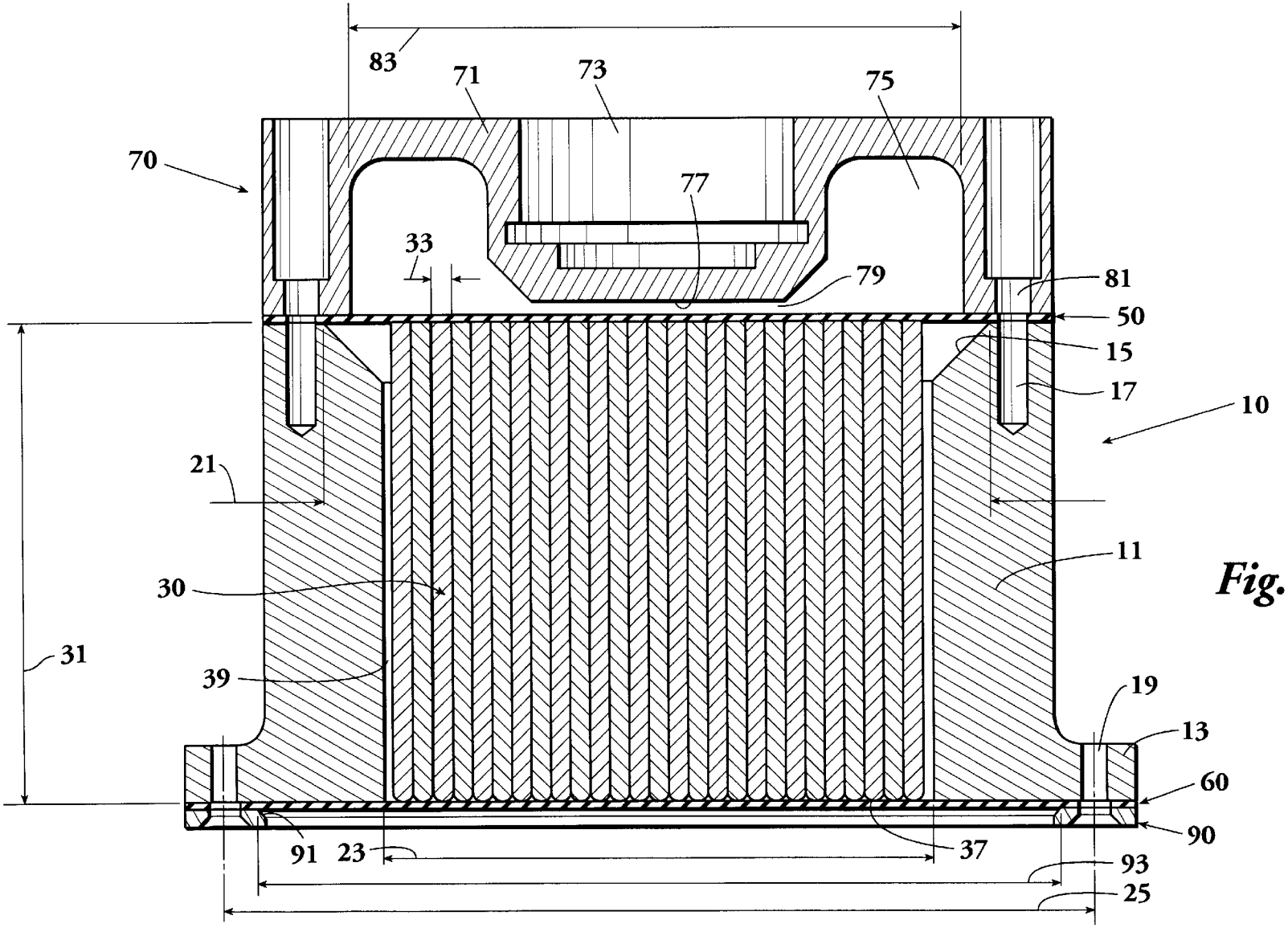
FIG. 3 is a diametric cross-section of the pneumatically assisted unidirectional conformal tool of FIG. 1.

The cap 270 of this preferred embodiment is similar in all respects to the cap 70 of the embodiment illustrated in FIG. 2, except that the interior vertical wall of the cap 270 is threaded for engagement on the threaded outer surface of the housing 210 and is provided on its lower horizontal surface with an annular groove as will hereinafter be described in reference to FIGS. 10 and 11. The ring 290 consists of a horizontal retaining portion 291 from which upwardly extends a rim 293 which is preferably interiorly threaded for engagement with the threads on the exterior surface of the housing 210. The assembly is completed by several washers 295.

Figure 10:
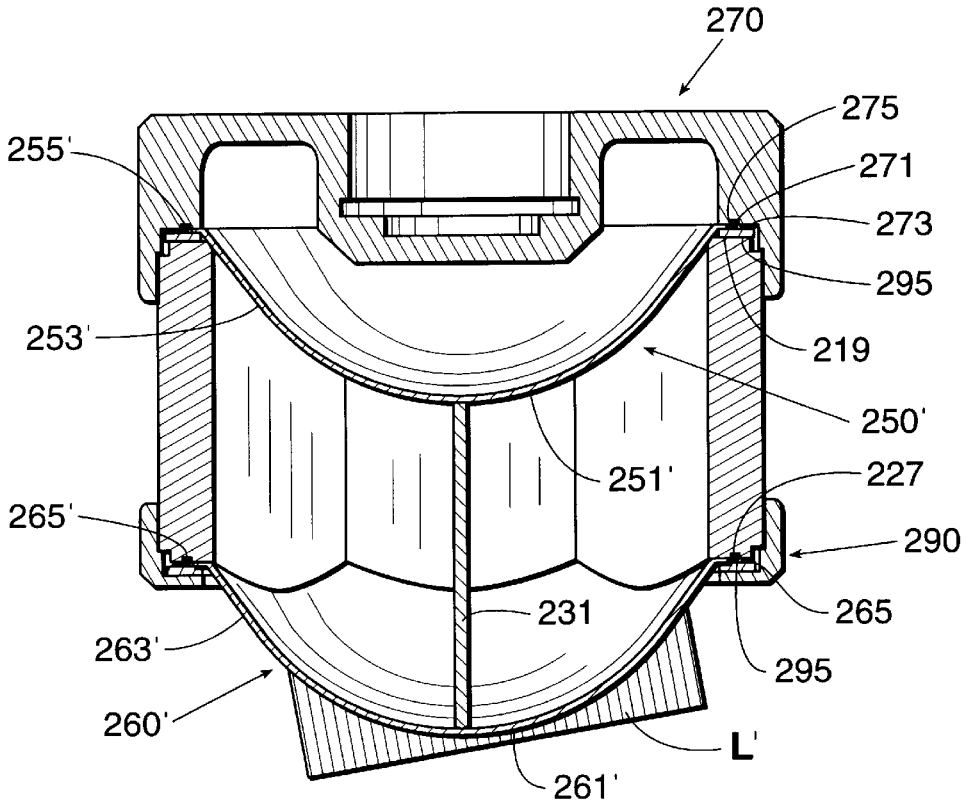
FIG. 10 is a sectional view of a large radial diaphragm embodiment of the pneumatically assisted unidirectional conformal tool.
Figure 11:
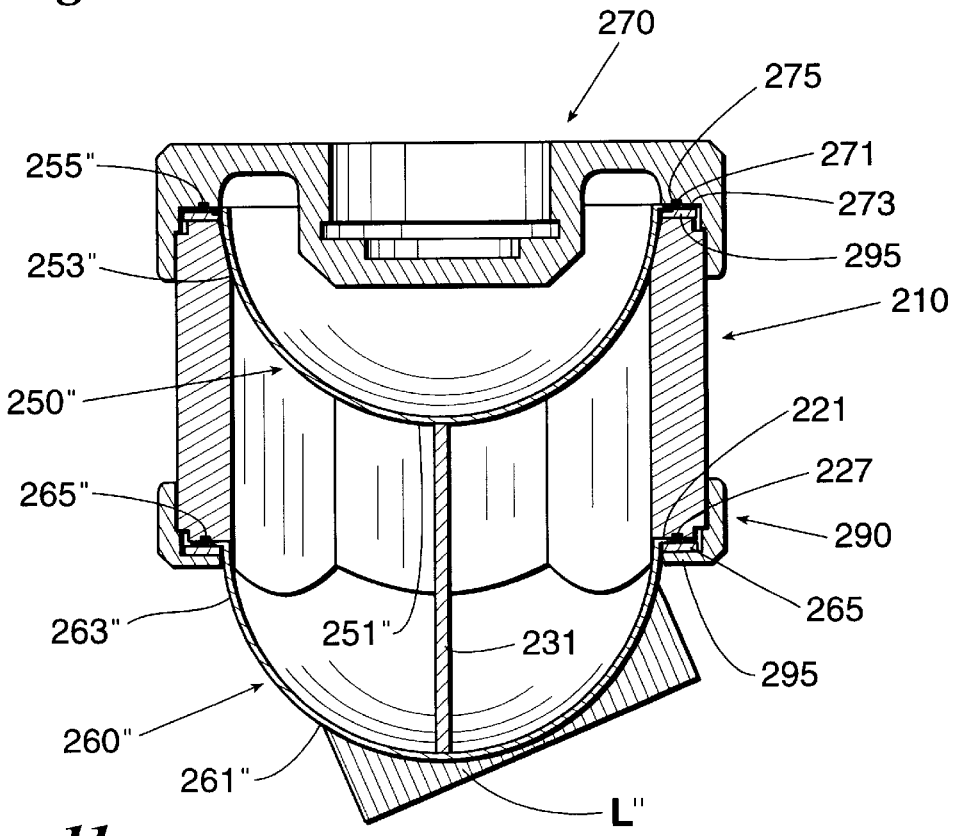
FIG. 11 is a sectional view of a small radial diaphragm embodiment of the pneumatically assisted unidirectional conformal tool.

Large and small radial diaphragm assemblies of the preferred embodiment of the pneumatically assisted unidirectional conformal tool of FIG. 6 are illustrated in FIGS. 10 and 11, respectively. In both assemblies, the lower diaphragm 260' or 260" has its peripheral bead 265' or 265" seated in the annular groove 227 in the lower planar surface 221 of the housing 210. The bead 265' or 265" is overlaid by one washer 295 and held in place by the rim 290 which is threadedly engaged onto the housing 210. The washer 295 prevents the ring 290 from binding against the bead 265' or 265" as the ring 290 is rotated into a tight condition on the housing 210. With the lower diaphragm 260' or 260" thus mounted on the housing 210, the cluster 230 of rods 231 is inserted into the interior of the housing 210. Another washer 295 may then be rested on the upper planar surface 219 of the housing 210. The upper diaphragm 250' or 250" is then seated in the spherical indentation 215 in the housing 210 with the bead 255' or 255" seated in an annular groove 271 in a seat 273 in the cap 270. The cap 270 is then threadedly engaged on the housing 210 to secure the upper diaphragm 250' or 250" in place. The washer 295 prevents binding of the bead 255' or 255" against the housing 210 as the cap 270 is tightened onto the housing 210.

The primary difference in the assemblies of FIGS. 10 and 11 is that the assembly of FIG. 10 is intended to fine/polish the surface of a lens L' having a curvature determined by a relatively large radius while the assembly of FIG. 11 is to be used to fine/polish a lens L" having a curvature of relatively smaller radius. Therefore, the webs 253' and 263' extending from the central spherical work surfaces 251' and 261', respectively, deviate outwardly from the spherical contour of the work surfaces 251' and 261' to extend to the beads 255' and 265' of the diaphragms. However, in the small radial diaphragm assembly of FIG. 11, the webs 253" and 263" are continuations of the spherical contour of the central spherical work surfaces 251" and 261", respectively.

The operation of the preferred embodiment is in most respects similar to the operation of the embodiment earlier described except that the arcuate contour of the lower diaphragm 260, and particularly the partially spherical contour of the central work surface 261, approximates the contour of the surface of the lens to be fined/polished and, therefore, enhances the ability of the conformal tool to conform the work surface 261 to the surface of the lens. Furthermore, the spherical indentation 215 and protrusion 217 on the upper and lower ends of the housing 210, respectively, assure that the interior walls 213 of the housing maintain contact with the outer surface of the cluster of rods 230 over a maximum longitudinal motion of the rods 231 so as to maximize the control of longitudinal rod travel provided by the housing 210. In this preferred embodiment, a housing 210 of length such that the rods 231 are in a range of from two to three inches in length and approximately 0.125 inches in diameter has been found to work satisfactorily. While it is preferred that the central spherical work surface 251 of the upper diaphragm 250 be also contoured to approximate the contour of the lens to be fined/polished so as to permit the use of rods 231 of equal length, an upper diaphragm 250 of any contour can be employed so long as the rod lengths are varied to extend fully from the upper diaphragm 250 to the central spherical work surface 261 of the lower diaphragm 260. While a right hexagonal arrangement or cluster of rods 230 within a right hexagonal housing interior 213 has been found to work satisfactorily, the cluster of rods 230 and the housing interior 213 may be of any desired cross sectional shape, including circular, polygonal or even elliptical. Furthermore, if the upper and lower diaphragms 250 and 260 are not similarly contoured, it may also be desirable to conform the indentation 215 in the upper end of the housing 210 to the contour of its diaphragm 250 so as to maintain maximization of control of the rod cluster 230 by the housing interior 213.

Thus, it is apparent that there has been provided, in accordance with the invention, a pneumatically assisted unidirectional conformal tool that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A tool for polishing/fining a lens comprising:

first and second resiliently elastic diaphragms, said second diaphragm having a central spherical work surface approximating a contour of the lens to be polished/fined;

a plurality of rods, each rod of said plurality of rods extending longitudinally from said first diaphragm to said second diaphragm spherical work surface; and means for holding said plurality of rods in sliding abutment in a cluster between said first diaphragm and said second diaphragm spherical work surface, whereby continuous distorting force applied longitudinally to an exterior surface of said first diaphragm is transmitted by longitudinal displacement among said cluster of rods to an interior surface of said second diaphragm to cause said second diaphragm spherical work surface to dynamically comply to a surface of a lens disposed across said second diaphragm spherical work surface as said second diaphragm spherical work surface and said lens are relatively laterally displaced.

2. A tool for polishing/fining a lens comprising:

first and second resiliently elastic diaphragms, each having a central spherical work surface approximating a contour of the lens to be polished/fined;

a plurality of rods of equal length, each rod of said plurality of rods extending longitudinally from said first diaphragm spherical work surface to said second diaphragm spherical work surface; and means for holding said plurality of rods in sliding abutment in a cluster between said diaphragm spherical work surfaces, whereby continuous distorting force applied longitudinally to an exterior surface of said first diaphragm is transmitted by longitudinal displacement among said cluster of rods to an interior surface of said second diaphragm to cause said second diaphragm spherical work surface to dynamically comply to a surface of a lens disposed across said second diaphragm spherical work surface as said second diaphragm spherical work surface and said lens are relatively laterally displaced.

3. A tool according to claim 2 further comprising means for applying pneumatic force to said first diaphragm exterior surface.

4. A tool for polishing/fining a lens comprising:

a housing open at opposite ends thereof;

first and second resiliently elastic diaphragms, one fixed across each of said ends, each having a central spherical work surface approximating a contour of the lens to be polished/fined; and a cluster of rods of equal length longitudinally aligned in sliding abutment within said housing, each rod of said cluster extending from said first diaphragm spherical work surface to said second diaphragm spherical work surface;

whereby continuous distorting force applied longitudinally to an exterior surface of said first diaphragm is transmitted by longitudinal displacement among said cluster of rods to an interior surface of said second diaphragm to cause said second diaphragm spherical work surface to dynamically comply to a surface of a lens disposed across said second diaphragm spherical work surface as said second diaphragm spherical work surface and said lens are relatively laterally displaced.

5. A tool according to claim 4 further comprising a cap fixed to said housing and defining a pneumatic chamber between said first diaphragm exterior surface and an interior wall of said cap and a passage through said cap for admitting air under pressure into said chamber.

6. A tool according to claim 4, said housing having a right cylindrical interior and said cluster of rods being right cylindrical.

7. A tool according to claim 6 further comprising a cap fixed to said housing and defining a cylindrical pneumatic chamber longitudinally aligned between said first diaphragm exterior surface and an interior wall of said cap and a passage through said cap for admitting air under pressure into said pneumatic chamber.

8. A tool according to claim 6, said cluster of rods being right cylindrical, further comprising means girding said cylindrical cluster and contacting said housing interior for holding said cluster in longitudinal alignment within said housing.

9. A tool according to claim 8, said girding and contacting means comprising a plurality of serially abutting substantially identical isometric trapezoidal plates and means for securing said plates in serial abutment.

10. A tool according to claim 9, said securing means comprising at least one resiliently elastic means stretched about said serially abutting plates.

11. A tool according to claim 10 further comprising at least one slot in an outer surface of at least one of said plates, said resiliently elastic means being seated therein.

12. A tool for polishing/fining a lens comprising:

a housing having a right cylindrical interior open at first and second ends thereof;

a first resiliently elastic diaphragm extending across said first end and having a central spherical work surface approximating a contour of the lens to be polished/fined;

a cap having a rim disposed against an exterior perimeter of said first diaphragm, said rim defining a cylindrical pneumatic chamber longitudinally aligned between an exterior surface of said first diaphragm and an interior wall of said cap and having a passage therethrough for admitting air under pressure into said chamber;

a second resiliently elastic diaphragm extending across said second end and having a central spherical work surface approximating a contour of the lens to be polished/fined;

a ring disposed against an exterior perimeter of said second diaphragm;

a cylindrical cluster of rods of equal length longitudinally aligned in sliding abutment within said housing, each rod of said cluster extending from said first diaphragm spherical work surface to said second diaphragm spherical work surface; and means for securing said cap and said ring to said housing with said diaphragms therebetween whereby pneumatic distortion of said first diaphragm exterior surface is transmitted by longitudinal displacement among said cluster of rods to an interior surface of said second diaphragm to cause said second diaphragm spherical work surface to dynamically comply to a surface of a lens disposed across said second diaphragm spherical work surface as said second diaphragm spherical work surface and said lens are relatively laterally displaced.

13. A tool according to claim 12, said pneumatic chamber being longitudinally aligned with said housing interior and having a diameter greater than a diameter of said housing interior.

14. A tool according to claim 13, said housing having an annular chamfer about said first end thereof.

15. A tool according to claim 14, said chamfer having a diameter at said first end greater than said pneumatic chamber diameter.

16. A tool according to claim 12, said ring having an inner diameter substantially greater than said housing interior diameter.

17. A tool according to claim 12, said cap being adapted for mounting on a fining/polishing machine chuck.

18. A tool for polishing/fining a lens comprising:

a right polygonal housing having a spherical protrusion on a first end thereof with a first planar surface thereabout, a spherical indentation in a second end thereof with a second planar surface thereabout and a right polygonal interior extending through said protrusion and said indentation;

first and second resiliently elastic diaphragms fixed across said first and second planar surfaces, respectively, each said diaphragm having a central spherical work surface approximating a contour of the lens to be polished/fined; and a polygonal cluster of rods of equal length longitudinally aligned in sliding abutment within said right polygonal housing interior, each rod of said cluster extending from said first diaphragm spherical work surface to said second diaphragm spherical work surface;

whereby continuous distorting force applied longitudinally to an exterior surface said first diaphragm is transmitted by longitudinal displacement among said cluster of rods to an interior surface of said second diaphragm to cause said second diaphragm spherical work surface to dynamically comply to a surface of a lens disposed across said second diaphragm spherical work surface as said second diaphragm spherical work surface and said lens are relatively laterally displaced.

19. A tool according to claim 18, said right polygonal housing interior and said polygonal cluster of rods being hexagonal.

20. A tool according to claim 18, said diaphragms each having a peripheral web extending from said central work surface to a perimeter of said diaphragm and contoured for juxtaposition of said diaphragm perimeters against said housing planar end surfaces.

21. A tool according to claim 20 further comprising a cap having a rim with an annular seat disposed against said first diaphragm perimeter, said rim defining a cylindrical pneumatic chamber longitudinally aligned between said first diaphragm exterior surface and an interior wall of said cap and having a passage therethrough for admitting air under pressure into said chamber.

22. A tool according to claim 21 further comprising a ring disposed against said second diaphragm perimeter.

23. A tool according to claim 22, said diaphragms each having an integral bead along said perimeter, said cap having a first annular groove in said seat for nesting said first diaphragm bead therein and said housing having a second annular groove in said second planar surface for nesting said second diaphragm bead therein.

24. A tool according to claim 23 further comprising a pair of washers, one disposed between said first diaphragm bead and said first planar surface of said housing and one disposed between said second diaphragm bead and said ring.

25. A tool according to claim 24, said cap being threadedly engaged on said housing to seal said first diaphragm bead in said cap annular groove.

26. A tool according to claim 24, said ring being threadedly engaged on said housing to seal said second diaphragm bead in said housing annular groove.

* * * * *